US010400558B1

(12) United States Patent
Shahinpour et al.

(10) Patent No.: US 10,400,558 B1
(45) Date of Patent: Sep. 3, 2019

(54) FLUID-DISABLED DETONATOR AND METHOD OF USE

(71) Applicant: DynaEnergetics GmbH & Co. KG, Troisdorf (DE)

(72) Inventors: Arash Shahinpour, Troisdorf (DE); Andreas Robert Zemla, Much (DE); Christian Eitschberger, München (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 15/975,816

(22) Filed: May 10, 2018

Related U.S. Application Data

(60) Provisional application No. 62/647,103, filed on Mar. 23, 2018.

(51) Int. Cl.
*E21B 43/1185* (2006.01)
*E21B 43/117* (2006.01)
(Continued)

(52) U.S. Cl.
CPC ..... *E21B 43/1185* (2013.01); *E21B 43/117* (2013.01); *F42B 3/192* (2013.01); *F42C 19/02* (2013.01); *F42D 1/043* (2013.01)

(58) Field of Classification Search
CPC .... F42B 3/192; E21B 43/117; E21B 43/1185; E21B 43/11857; F42D 1/04; F42D 1/043;
(Continued)

(56) References Cited

U.S. PATENT DOCUMENTS 1,991,857 A 2/1935 Lewis
2,994,269 A * 8/1961 Schlumberger ..... E21B 43/117 175/4.54
(Continued)

FOREIGN PATENT DOCUMENTS

CN 202329443 U 7/2011
EP 0679859 A2 11/1995
(Continued)

OTHER PUBLICATIONS

Safety Mgmt Svcs, SMS-3517-L1 & SMS-3313-R1—Shipping & Test Report, 2014, 21 pgs, http://www.ocsresponds.com/ref/hazlist/db/smsreports/OOT-APRV-064_SMS-3313-R1_Rev_0.pdf.
(Continued)

*Primary Examiner* — James S Bergin
(74) *Attorney, Agent, or Firm* — Moyles IP, LLC

(57) ABSTRACT

A detonator for use with perforating gun assemblies is presented. The detonator includes a shell including a main explosive load. The shell may include one or more openings. A non-mass explosive body is disposed in the shell, adjacent the main explosive load. The non-mass explosive body includes one or more channels extending therethrough. The detonator includes a plug adjacent the non-mass explosive body, and a PCB adjacent the plug to facilitate electrical communication with the detonator. The plug may include an elongated opening extending therethrough. The channels of the non-mass explosive body, in combination with at least one of the openings of the shell or the elongated openings of the plug, are configured to introduce fluids, such as wellbore fluids, into the non-mass explosive body to disable the detonator.

20 Claims, 10 Drawing Sheets

(51) Int. Cl.

| | |
|---|---|
| ***F42B 3/192*** | (2006.01) |
| ***F42C 19/02*** | (2006.01) |
| ***F42D 1/04*** | (2006.01) |

(58) Field of Classification Search

CPC .. F42D 1/045; F42D 1/05; F42C 19/00; F42C 19/02; F42C 19/06

USPC ..... 102/202.1, 202.6, 424, 426; 89/1.15

See application file for complete search history.

(56) References Cited

U.S. PATENT DOCUMENTS

| | | | | |
|---|---|---|---|---|
| 4,762,067 | A | 8/1988 | Barker et al. | |
| 4,815,382 | A | 3/1989 | Yunan | |
| 5,070,788 | A | 12/1991 | Carisella et al. | |
| 5,192,828 | A | 3/1993 | Austin et al. | |
| 5,503,077 | A * | 4/1996 | Motley | F42B 3/13 102/202.1 |
| 5,703,319 | A | 12/1997 | Fritz et al. | |
| 7,891,296 | B2 | 2/2011 | Husk et al. | |
| 8,033,222 | B1 | 10/2011 | Sutula, Jr. et al. | |
| 8,091,477 | B2 | 1/2012 | Brooks et al. | |
| 8,230,788 | B2 | 7/2012 | Brooks et al. | |
| 8,485,097 | B1 | 7/2013 | Nance et al. | |
| 8,661,978 | B2 | 3/2014 | Backhus et al. | |
| 8,746,144 | B2 | 6/2014 | Givens et al. | |
| 8,934,214 | B2 | 1/2015 | Barker et al. | |
| 9,146,084 | B2 | 1/2015 | Muller et al. | |
| 9,243,877 | B2 | 1/2016 | Hayes et al. | |
| 9,423,229 | B1 | 8/2016 | Rice | |
| 9,523,265 | B2 | 12/2016 | Upchurch et al. | |
| 9,581,422 | B2 * | 2/2017 | Preiss | F42C 19/12 |
| 9,598,941 | B1 | 3/2017 | Upchurch et al. | |
| 9,605,937 | B2 * | 3/2017 | Eitschberger | F42C 19/12 |
| 9,822,618 | B2 * | 11/2017 | Eitschberger | E21B 43/1185 |
| 2004/0055494 | A1 | 3/2004 | O'Brien | |
| 2016/0356132 | A1 | 12/2016 | Burmeister et al. | |

FOREIGN PATENT DOCUMENTS

| | | | |
|---|---|---|---|
| WO | WO-1996004523 | A1 | 2/1996 |
| WO | WO-1996011376 | A1 | 4/1996 |
| WO | WO-2001029499 | A1 | 4/2001 |
| WO | WO-2016011463 | A1 | 1/2016 |

OTHER PUBLICATIONS

Core Lab, User Recommendations for 321 Bottom Fire Detonator, 2017, 7 pgs, http://www.corelab.com/owen/CMS/docs/Manuals/det/MAN-DET-3050-321-DS-R05.pdf.

Alford, Plain Detonator Adaptor, Feb. 8, 2015, 3 pgs, http://explosives.net/product/plain-detonator-adaptor/.

AEL Mining Services, Electronic Initiators, Jul. 9, 2015, 2 pgs, http://www.aelminingservices.com/products/initiating-systems/electronic-initiators.

Austin Powder Company, A-140 F & Block Fluid Disabled Resistorized Instantaneous RDX Detonator Assembly, Jan. 5, 2017, 3 pgs., https://www.austinpowder.com/blasters_guide/pib/OilStar_A140Fbk.pdf.

Dynaenergetics, DYNAselect Electronic Detonator 0015 SFDE RDX 1.4B, Product Information, Dec. 16, 2011, 1 pg.

Dynaenergetics, DYNAselect Electronic Detonator 0015 SFDE RDX 1.4S, Product Information, Dec. 16, 2011, 1 pg.

International Search Report and Written Opinion of International App. No. PCT/EP2019/052561, dated Apr. 29, 2019, which is in the same family as U.S. Appl. No. 15/975,816, 13 pgs.

* cited by examiner

FLUID-DISABLED DETONATOR AND METHOD OF USE

CROSS-REFERENCE TO RELATED APPLICATIONS

This application claims the benefit of U.S. Provisional Application No. 62/647,103 filed Mar. 23, 2018, which is incorporated herein by reference in its entirety.

FIELD OF THE DISCLOSURE

This disclosure generally relates to a detonator for use with a perforating gun system. More specifically, the detonator is capable of being fluid-disabled in the event that the perforating gun system leaks or is flooded with a fluid.

BACKGROUND OF THE DISCLOSURE

Perforating gun assemblies are used to generate holes in steel casing pipe/tubing and/or cement lining in a wellbore to gain access to the oil and/or gas formation. During the process of perforating the oil and/or gas formation, the perforating gun assembly is lowered into and positioned properly in the wellbore. Typical perforating gun assemblies include a carrier and a plurality of shaped charges housed in the carrier. The shaped charges are initiated to create holes in the casing and to blast through the formation so that the hydrocarbons can flow through the casing. Each shaped charge is connected to each other via a detonation cord. The detonation cord is typically coupled to a detonator, such as percussion detonator or an electrical detonator. Electrical detonators typically include hot-wire detonators, semiconductor bridge detonators, or exploding foil initiator (EFI) detonators. Once the detonator is activated/initiated, the detonator begins a sequence of events that initiate the detonation cord, and thereby the shaped charges of the perforation gun assembly.

The perforating gun assembly may spend some time in the fluid-filled environment of the wellbore prior to the initiation of the detonator, and thus the shaped charges. If the gun assembly develops a leak which allows wellbore fluids to enter the perforating gun assembly, several undesirable things may occur, including severe damage to the perforating gun assembly. The assembly may misfire, only partially fire, fire low-order and thereby split/burst open and plug/obstruct the wellbore, and the like.

In view of the continually increasing safety requirements and the problems described hereinabove, there is a need for a detonator for use in a perforating gun system that provides additional precaution against the firing of the perforating gun system when there is a potential leakage of fluid in the perforating gun system. Furthermore, there is a need for a detonator this is capable of being fluid-disabled/fluid desensitized in the presence of fluids in the perforating gun system. Additionally, there is a need for a detonator that facilitates the entry of fluids into the detonator to abort the firing sequence of the perforating gun system.

BRIEF DESCRIPTION OF THE EXEMPLARY EMBODIMENTS

According to an aspect, the present disclosure may be associated with a detonator for use with perforating gun assemblies. The detonator includes a shell having a closed end, an open end, and a hollow interior between the closed and open ends. One or more openings extend through the shell from the hollow interior. The detonator includes a non-mass explosive body disposed within the hollow interior. The non-mass explosive body includes a head portion and a leg portion opposite the head portion. One or more channels are formed between the head portion and the leg portion, and are in fluid communication with the openings. A main explosive load is disposed at the closed end of the shell, and is sandwiched between the closed end and the head portion. The openings, in combination with the channels, are configured to introduce fluids, such as wellbore fluids, into the non-mass explosive body to disable the detonator.

The present disclosure further describes the detonator including a cylindrical plug positioned at the open end of the shell and at least partially disposed in the hollow interior. The plug includes an elongated opening that extends along a length of the plug. The elongated opening facilitates communication of the fluid(s) into the shell, and to the non-mass explosive body. According to an aspect, the elongated opening and the channels are configured to introduce the fluid into the non-mass explosive body to disable the detonator.

According to an aspect, the detonators described hereinabove are particularly suited for use in a perforating gun system/perforating gun assembly.

The present embodiments also relate to a method of using a detonator in a wellbore. The method includes positioning the detonator within a perforation gun system. The detonator is substantially as described hereinabove, and includes a shell having a closed end, an open end, and a hollow interior extending between the closed and open ends. A main explosive load is disposed within the hollow interior and a non-mass explosive body abuts the main explosive load. A cylindrical plug including an elongated opening may be positioned at the open end of the shell and may be at least partially disposed within the hollow interior. The method includes lowering the perforating gun system into the wellbore, and initiating the detonator to trigger an explosive reaction. According to an aspect, in the event that fluid has leaked into or flooded the perforating gun system, the openings of the shell in combination with channels, alternatively the elongated opening of the cylindrical plug and the channels of the non-mass explosive body, introduces the fluid into the non-mass explosive body to disable the detonator.

BRIEF DESCRIPTION OF THE DRAWINGS

A more particular description will be rendered by reference to specific embodiments thereof that are illustrated in the appended drawings. Understanding that these drawings depict only typical embodiments thereof and are not therefore to be considered to be limiting of its scope, exemplary embodiments will be described and explained with additional specificity and detail through the use of the accompanying drawings in which.

Figure 1:
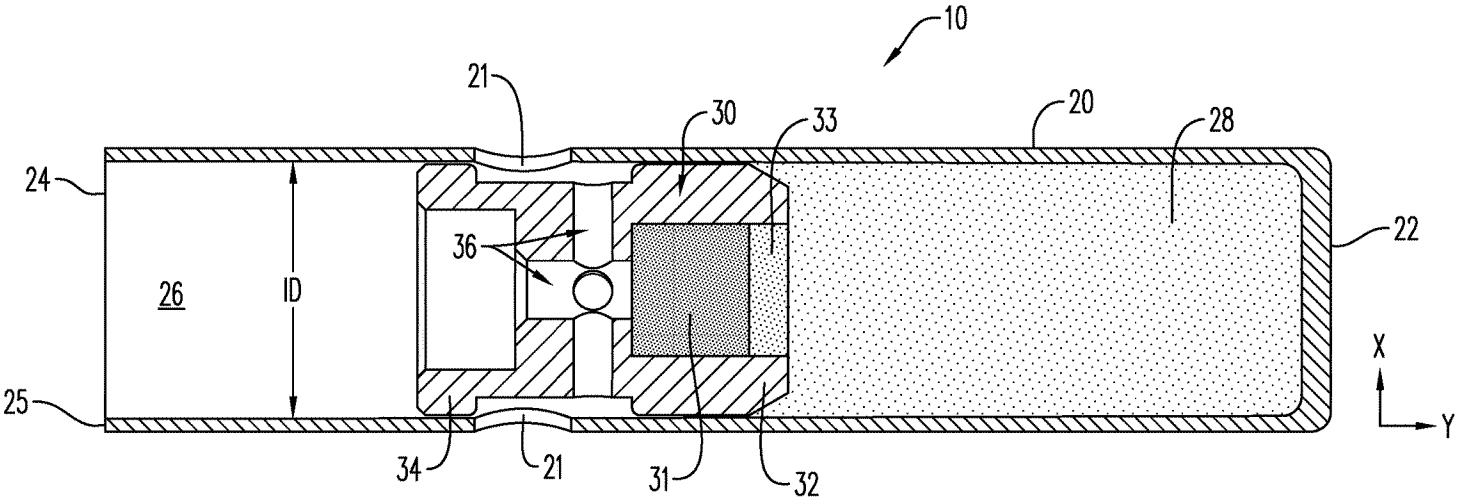
FIG. 1 is a cross-sectional view of a non-mass explosive body of a detonator, according to an embodiment.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to some embodiments.

The headings used herein are for organizational purposes only and are not meant to limit the scope of the description or the claims. To facilitate understanding, reference numerals have been used, where possible, to designate like elements common to the figures.

DETAILED DESCRIPTION

Reference will now be made in detail to various embodiments. Each example is provided by way of explanation, and is not meant as a limitation and does not constitute a definition of all possible embodiments.

As used herein, "fluid-disabled" means that if a perforating gun has a leak and fluid enters the perforating gun, a detonator of the perforating gun system is disabled/deactivated by the presence of the fluid, which breaks the explosive train. This prevents the perforating gun from potentially splitting/bursting open while inside a wellbore, and potentially plugging the wellbore.

For purposes of illustrating features of the embodiments, reference will be made to various figures. FIGS. 4-7C and illustrate various embodiments of a detonator/a fluid-disabled detonator for use in a perforating gun assembly. As will be discussed in connection with the individual illustrated embodiments, the detonator generally includes a shell having a hollow interior, and an explosive load disposed within the hollow interior of the shell. According to an aspect, a non-mass-explosive body is disposed within the shell adjacent the explosive load. A cylindrical plug is positioned at an open end of the shell, so that the non-mass explosive body is between the plug and the explosive load. The non-mass explosive body includes channels that are configured to introduce the fluid into the non-mass explosive body to disable the detonator. According to an aspect, the shell may include one or more openings that extend from the hollow interior and communicate with channels formed in the non-mass-explosive body. The openings of the shell, in combination with the channels of the non-mass-explosive body may help to disable the detonator in the event that fluids are introduced into the openings and thereby, the channels of the non-mass-explosive body. According to aspect, the cylindrical plug includes an elongated opening that, in combination with the channels of the non-mass-explosive body, helps to disable the detonator in the event that fluids are introduced into the elongated opening and thereby, the channels of the non-mass-explosive body.

Embodiments of the disclosure may be associated with a detonator/fluid-disabled detonator 10. According to an aspect, and as illustrated in FIG. 1, the fluid-disabled detonator 10 includes a shell 20 having a closed end 22 and an open end 24. A hollow interior 26 extends between the closed and open ends 22, 24. The hollow interior 26 may function as a chamber for receiving one or more components of the detonator 10. According to an aspect, the shell 20 includes one or more openings 21. The openings 21 function as ports or flood channels that facilitate the introduction of fluids into the hollow interior 26, and as described in further detail hereinbelow, the introduction of the fluids in the hollow interior 26 may disable the detonator 10. This may be particularly suited for applications where fluids, such as wellbore fluid, may flood the perforating gun in which the detonator 10 is installed. The detonator will be disabled in such circumstances, thereby preventing a potentially damaging misfire, partially fire, or low-order firing of the perforating gun. The openings 21 may be dimensioned (i.e., shaped, sized or angled) to allow fluids to pass through the shell 20 and into the hollow interior 26. According to an aspect, the openings 21 have a diameter of about 1 mm to about 3 mm, alternatively from about 0.5 mm to about 5 mm. While the openings 21 are illustrated as being circular, the openings 21 may have any desired shape. According to an aspect, a pair of the openings 21 are positioned opposite each other. The arrangement and the number of openings 21 may be selected based on the needs of the application.

A main explosive load 28 is disposed within the hollow interior 26 of the shell 20. As illustrated in FIGS. 1 and 4-6, the main explosive load 28 partially fills the hollow interior 26, and abuts the closed end 22 of the shell 20. According to an aspect, the main explosive load 28 only fills the portion of hollow interior 26 that is between the openings 21 and the closed end 22 of the shell 20. In other words, the main explosive load 28 does not communicate with the environment outside of the shell via the openings 21. The main explosive load 28 includes compressed secondary explosive materials. According to an aspect, the main explosive load 28 includes one or more of cyclotrimethylenetrinitramine (RDX), octogen/cyclotetramethylenetetranitramine (HMX), hexanitrostilbene (HNS), pentaerythritol tetranitrate (PETN), and 2,6-Bis(picrylamino)-3,5-dinitropyridine (PYX). The type of explosive material used may be based at least in part on the operational conditions in the wellbore and the temperature downhole to which the explosive may be exposed.

A non-mass-explosive (also referred to herein as a NME) body is 30 is disposed in the hollow interior 26 of the shell 20, adjacent the main explosive load 28. As illustrated in FIGS. 1 and 4-6, the non-mass-explosive body 30 sandwiches the main explosive load 28 between the closed end 22 of the shell and the non-mass-explosive body 30. In this configuration, the main explosive load 28 is contained within the hollow interior 26 of the shell 20 and is not exposed to the environment external to/outside of the shell 20.

Figure 2:
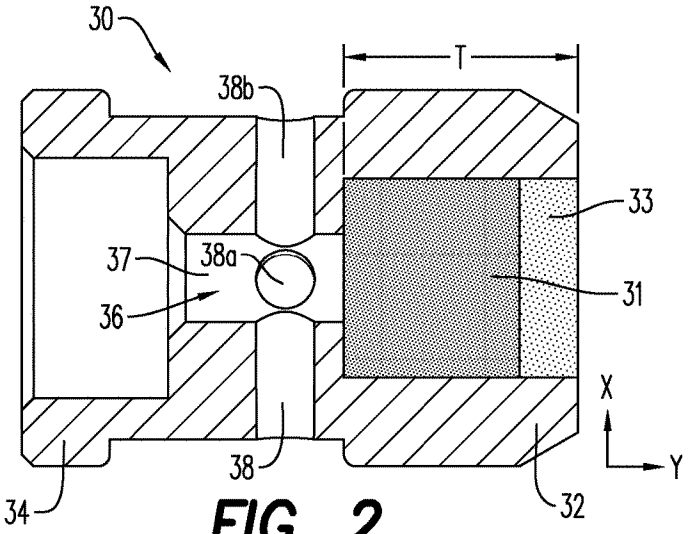
FIG. 2 is a cross-sectional view of the non-mass explosive body of FIG. 1.

FIG. 2 illustrates the non-mass-explosive body 30 in detail. The non-mass explosive body 30 may have a substantially cylindrical shape. According to an aspect, the non-mass explosive body 30 includes a head portion 32 and a leg portion 34 opposite the head portion 32. The head portion 32 is configured to abut the main explosive load 28, so that the main explosive load 28 is sandwiched between the closed end 22 and the head portion 32. The non-mass explosive body 30 also helps to enclose the main explosive load 28 in the hollow interior 26 of the shell 20.

The head portion 32 of the non-mass explosive body 30 includes a primary explosive 31. The primary explosive 31 may be embedded within the head portion 32 in such a manner that protects the primary explosive 31 from being unintentionally initiated. As would be understood by one of ordinary skill in the art, explosives of typical detonator assemblies may be unintentionally initiated due to shock, impact and/or any friction forces. A secondary explosive 33 abuts the primary explosive 31, and seals the primary explosive 31 within the head portion 32. The primary and secondary explosives 31, 33 collectively have a total thickness T of about 3 mm to about 30 mm, alternatively about 3 mm to about 10 mm. The secondary explosive 33 may be configured as a layer of an explosive material. According to an aspect, the primary explosive 31 includes at least one of lead azide, silver azide, lead styphnate, tetracene, nitrocellulose, and BAX.

Each of the primary and secondary explosives 31, 33 have a safe temperature rating of above 150° C. (with the exception of PETN, which has a rating of approximately 120° C.). The secondary explosive 33 may include a material that is less sensitive to initiation, as compared to the primary explosive 31. The secondary explosive 33 may include at least one of PETN, RDX, HMX, HNS and PYX. In an embodiment, the secondary explosive 33 may be less sensitive to initiation than PETN. As would be understood by one of ordinary skill in the art, the sensitivities of the primary and secondary explosives 31, 33 refer to the degree to which they can be initiated by impact (Nm), heat, friction (N) or other forms of mechanical forces. Since the secondary explosive 33 has a lower degree of sensitivity than the primary explosive 31, it is not required for the secondary explosive 33 to be housed within an additional NME type safety body within the shell 20, in order to avoid an unintentional initiation by an external mechanical force.

One or more channels 36 are arranged between the head and leg portions 32, 34. As illustrated in FIGS. 1 and 4-6, the channels 36 are in fluid communication with the openings 21 of the shell 20. The openings 21, in combination with the channels 36, are configured to introduce fluids into the hollow interior 26 of the non-mass explosive body 30 so as to disable the detonator 10 and prevent initiation of the main explosive load 28. The openings 21 may be offset from the channels 36 to prevent the resistor 42 (as described hereinbelow) from direct exposure to voltage sparks that may occur during electrostatic discharge (ESD) testing.

The channels 36 include a first channel 37 and a second channel 38. The first channel 37 extends along a lengthwise dimension of the detonator 10 (i.e., along the Y-axis of the detonator 10) a distance from about 0.5 mm to about 5 mm, alternatively about 0.5 mm to about 3 mm. Alternatively, the second channel 38 extends along a transverse dimension of the detonator 10 (i.e., along the X-axis of the detonator 10) at a distance of about 0.5 mm to about 5 mm, alternatively about 1 mm to about 3 mm. When the channels 36 include the first and second channels 37, 38, the first channel 37 and the second channel 38 intersect one another so that the first channel 37 is in fluid communication with the second channel 38. According to an aspect, the second channel 38 includes a primary distribution channel **38*a* and a secondary distribution channel 38*b*. Each distribution channel 38*a*, 38*b* intersects the other in a cross-wise direction so that they are fluidly connected to each other. When the channels 36 includes the first channel 37, the primary distribution channel 38*a* and the secondary distribution channel 38*b*, each of the channels 37, 38*a*, 38*b* intersect one another so that the first channel 37 is in fluid communication with the primary and secondary distribution channels 38*a*, 38*b***.

The non-mass explosive body 30 is composed of an electrically conductive, electrically dissipative or electrostatic discharge (ESD) safe synthetic material. According to an aspect, the non-mass-explosive body 30 includes a metal, such as cast-iron, zinc, machinable steel or aluminum. Alternatively, the non-mass-explosive body 30 may be formed from a plastic material. While the non-mass-explosive body 30 may be made using various processes, the selected process utilized for making the non-mass-explosive body 30 is based, at least in part, by the type of material from which it is made. For instance, when the non-mass-explosive body 30 is made from a plastic material, the selected process may include an injection molding process. When the non-mass-explosive body 30 is made from a metallic material, the non-mass-explosive body 30 may be formed using any conventional CNC machining or metal casting processes.

Figure 3:
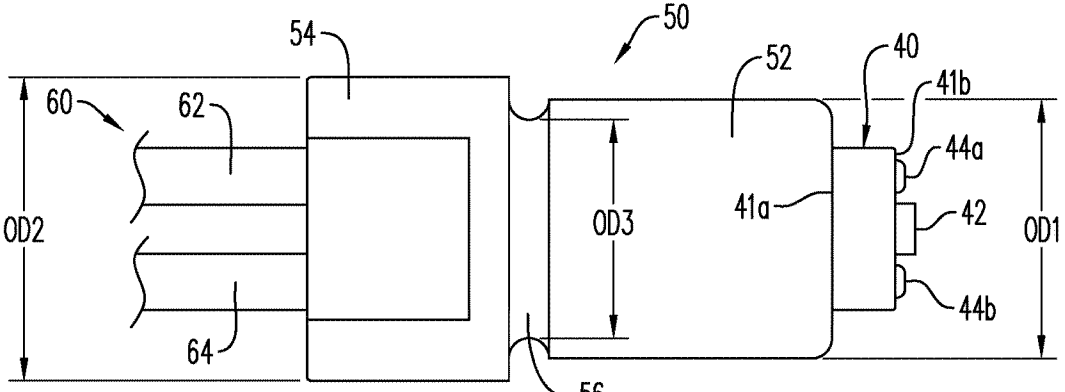
FIG. 3 is a side view of a cylindrical plug for being disposed in a hollow interior of a detonator, according to an embodiment.
Figure 4:
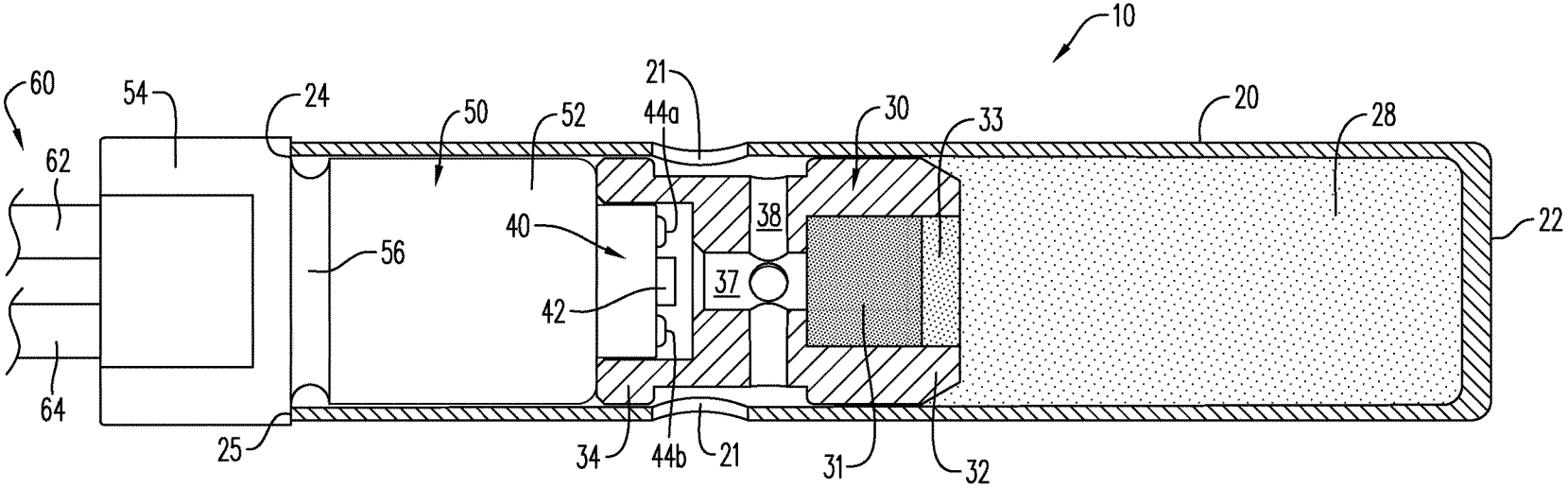
FIG. 4 is a partial cross-sectional side view of an assembled detonator, according to an embodiment.
Figure 5:
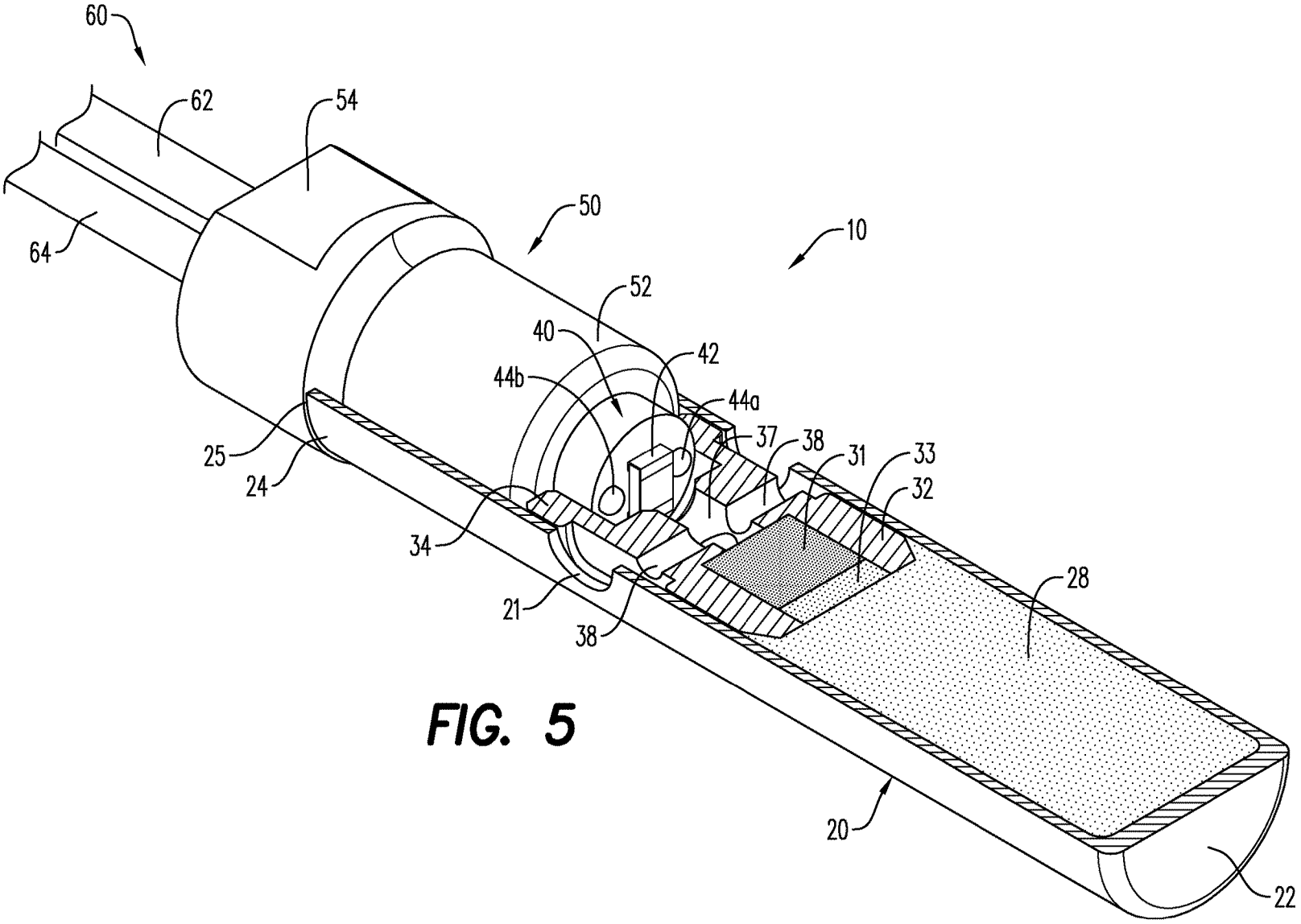
FIG. 5 is a perspective, partial cross-sectional view of the detonator of FIG. 4, illustrating the orientation of first and second channels of a non-mass explosive body, according to an embodiment.
Figure 6:
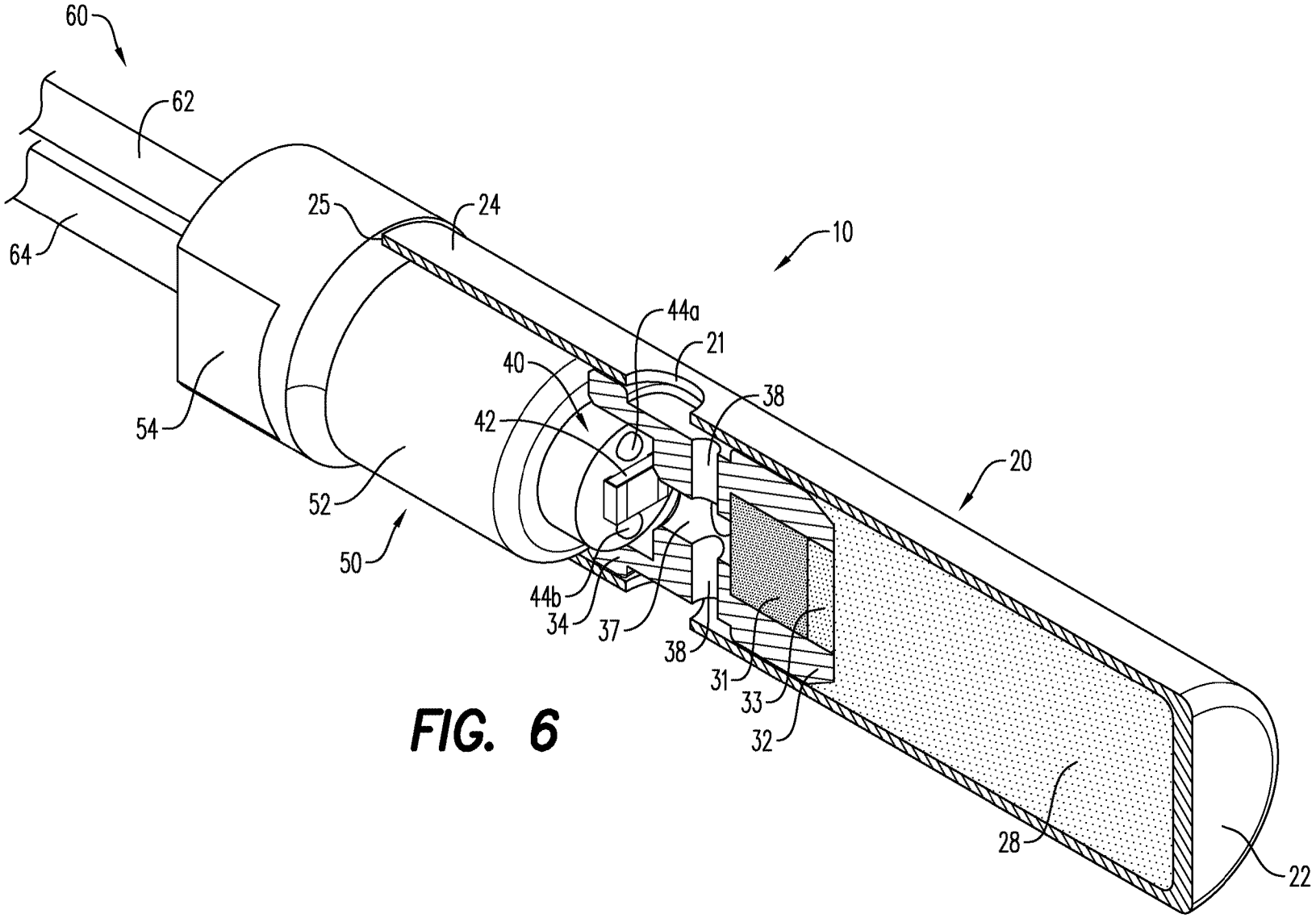
FIG. 6 is a perspective, partial cross-sectional side view of the detonator of FIG. 4, illustrating openings formed in a shell of the detonator, according to an embodiment.

According to an aspect, the detonator 10 includes a cylindrical plug 50. The plug 50 is configured for being at least partially disposed in the hollow interior 26 of shell, adjacent the open end 24, as illustrated in FIGS. 4-6. The plug 50 is illustrated in FIG. 3 including a first portion 52 having a first outer diameter OD1, and a second portion 54 that has a second outer diameter OD2 that is greater than the first outer diameter OD1. The first portion 52 is sized so that it is substantially the same as or slightly less than an inner diameter ID of the shell 20. The cylindrical plug 50 is shown in FIGS. 4-6 as being partially disposed within the hollow interior 26 of the shell 20, with the first portion 52 being entirely disposed within the hollow interior 26 and the second portion 54 extending outside the hollow interior 26. In this configuration, the non-mass-explosive body 30 and the main explosive load 28 are enclosed within the shell 20, by virtue of the second end 54 of the plug 50 closing the open end 22 of the shell 20. As illustrated in FIGS. 4-6, the second portion 54 is seated adjacent a peripheral edge 25 of the shell 20. The second outer diameter OD2 is larger than the first outer diameter OD1, so that the second outer diameter OD2 serves as a stop point at the edge 25 of the shell 20 during assembly of the plug 50 into the shell 20.

FIG. 3 illustrates a recessed area 56 extending around the circumference of the plug 50, between the first and second portions 52, 54. The recessed area 56 has an outer diameter OD3 that is less than both the first and second outer diameters OD1, OD2 of the first and second portions 52, 54, respectively. According to an aspect, the recessed area 56 is a crimping cavity for receiving the peripheral edge 25 of the shell 20. During assembly of the detonator 10, the peripheral edge 25 of the shell 20 may be indented into the recessed area 56 of the plug 50, which helps to secure the shell 20 onto the plug 50 and prevent the shell 20 from being flown off or detached from the plug 50 during initiation of the detonator 10.

The detonator 10 further includes a printed circuit board (PCB) 40. The PCB 40 may have a generally cylindrical shape, and may be disposed in a slot formed by the leg portion 34 of the non-mass explosive body 30. A first end 41*a* of the PCB 40 may be coupled or otherwise secured to the first portion 52 of the plug 50 using any known fastening mechanism. A second end 41*b* of the PCB houses a plurality of components. Such components may include a plurality of contact/relay contacts. As illustrated in, for instance, FIG. 3, the PCB 40 may include a first contact 44*a* and a second contact 44*b*. The contacts 44*a*, 44*b* are secured to the second end 41*b* of the PCB 40, and are spaced apart from each other. A resistor 42 is disposed between the first contact 44*a* and the second contact 44*b*, and is in electrical communication with them. According to an aspect, the resistor 42 is a film resistor or a surface mounted resistor. The resistor 42 may be a thin-filmed resistor, having a thickness between about 10 μm to about 1000 μm, alternatively between about 10 μm to about 500 μm.

According to an aspect, leg wires 60 extend through the plug 50. The leg wires 60 are configured to provide electrical connection to the PCB 40. According to an aspect, the leg wires include a first leg wire 62, and a second leg wire 64 spaced apart from the first leg wire 62. The first leg wire 62 is electrically coupled to the first contact 44*a*, while the second leg wire 64 is electrically coupled to the second contact 44*b* (see, for example, FIG. 7A). The first and second leg wires 62, 64 are both configured to provide electrical connection to the printed circuit board 40.

When the detonator 10 is in use, it is typically axially aligned with an end of a detonating cord (not shown). According to an aspect, upon receiving a sufficient current from the leg wires 62, 64 (and directly from the contacts 44*a*, 44*b*), the resistor 42 explodes to generate a high-energy plasma cloud. In the event that the perforating gun in which the detonator 10 is assembled is not flooded, the high-energy plasma cloud travels initiates the primary explosive 31 (and when included, the secondary explosive 33) embedded within the head portion 32 of the detonator 10. The initiation of the primary explosive 31 results in the initiation of the main explosive load 28 housed in the hollow interior 26 of the shell 20. Initiation of the main explosive load 28 may further initiate the axially-aligned detonating cord (not shown) adjacent the closed end 22 of the shell 20. In the event that a fluid has leaked into or flooded the perforating gun system, the channels of the non-mass explosive body 30 facilitate entry of the fluid into the non-mass explosive body 30 to create a barrier between the resistor 42 and the primary explosive 31, which prevents initiation of the main explosive load 28 and disables the detonator 10.

Figure 7A:
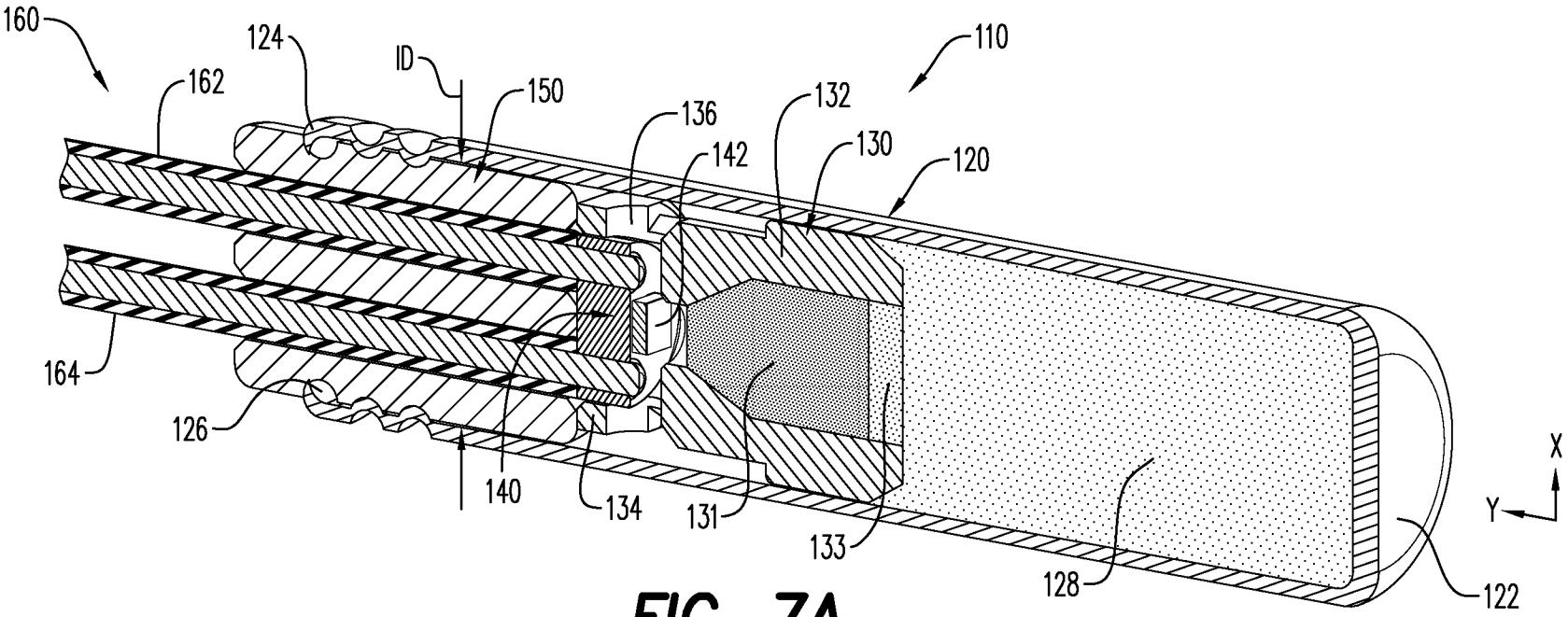
FIG. 7A is a cross-sectional view of a detonator including a non-mass explosive body and a cylindrical plug, according to an embodiment.
Figure 7B:
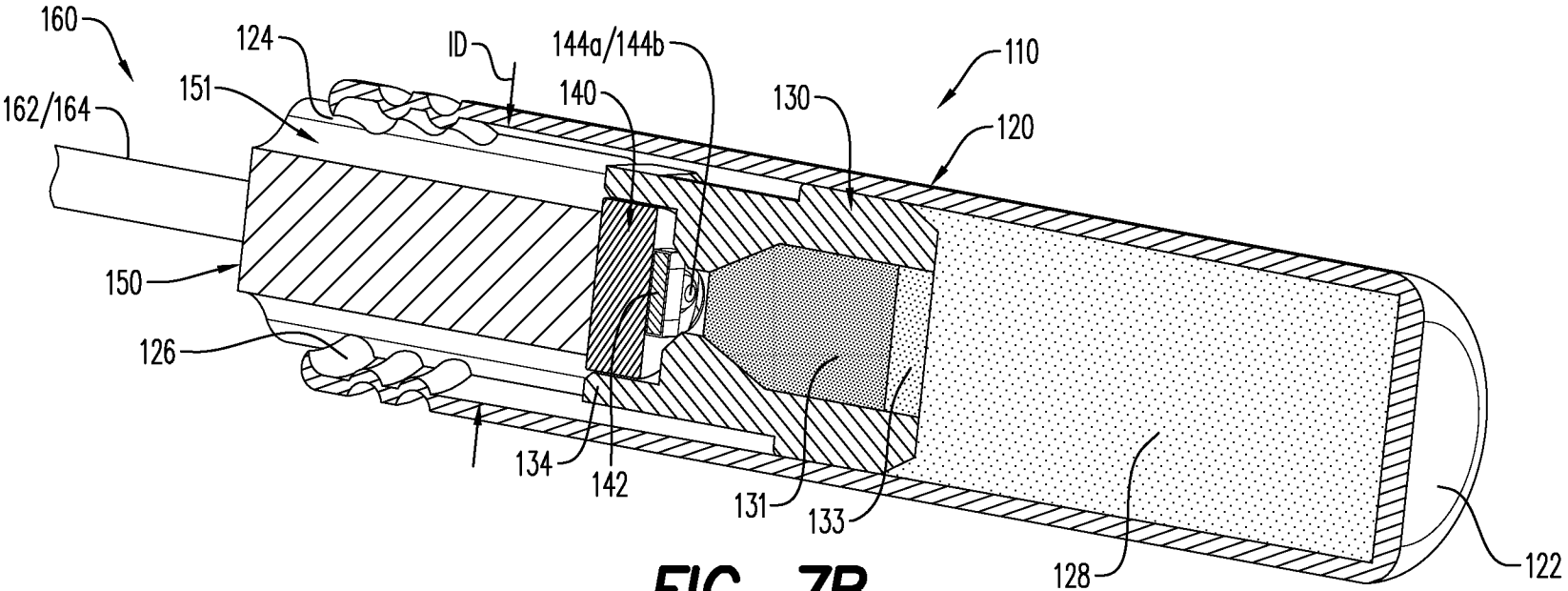
FIG. 7B is a cross-sectional view of the detonator of FIG. 7A, illustrating the cylindrical plug including elongated openings, according to an embodiment.
Figure 7C:
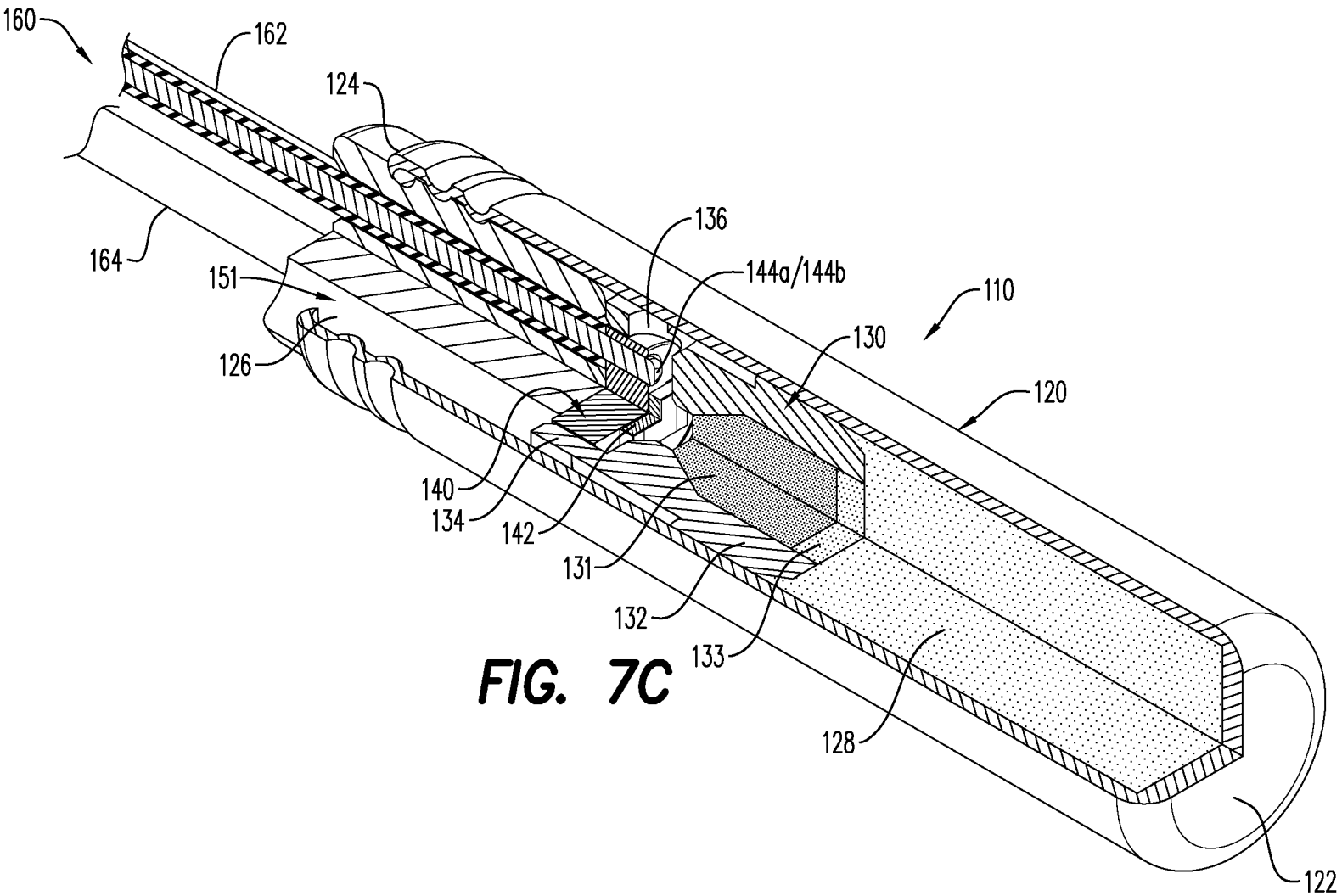
FIG. 7C is a cut away view of the detonator of FIG. 7A.
Figure 9A:
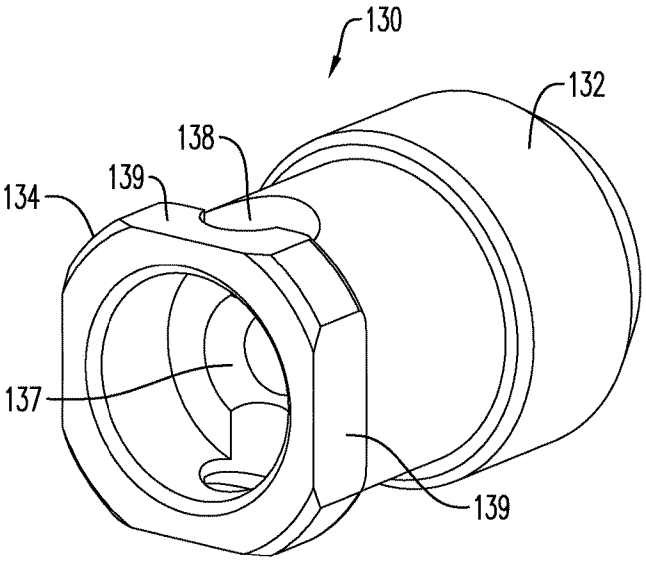
FIG. 9A is a perspective view of the non-mass explosive body of FIG. 8.
Figure 9B:
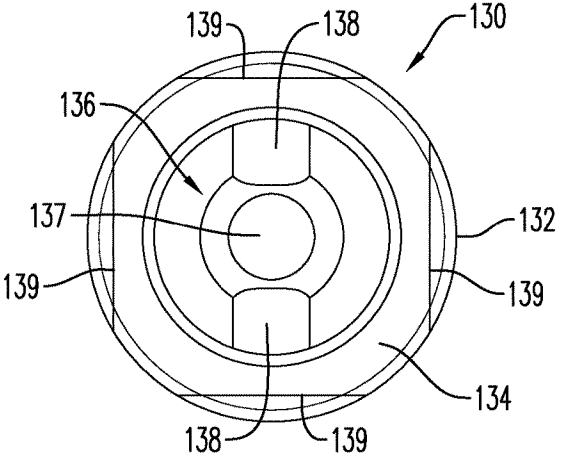
FIG. 9B is a top down view of the non-mass explosive body of FIG. 8.

Further embodiments of the disclosure are associated with a detonator/fluid-disabled 110, as illustrated in FIGS. 7A-7C. For purposes of convenience, and not limitation, the general characteristics of the detonator 10, though applicable to the detonator 110, are described above with respect to the FIGS. 1-6, and are not repeated here. Differences between the detonator 10 and the detonator 110 will be elaborated below.

FIGS. 7A-7B illustrate a cross-sectional view of the detonator 110. The detonator 110 includes a substantially cylindrical shell 120. The shell 120 includes a closed end 122, an open end 124, and a hollow interior 126 extending between the closed and open ends 122, 124. The shell 120 only has a single opening (i.e., the open end 124), which may communicate external materials into the hollow interior 126. A main explosive load 128 is disposed within the hollow interior 126. According to an aspect, the main explosive load 128 abuts the closed end 122 of the shell 120 and only partially fills the hollow interior 126. The main explosive load 128 includes one or more of RDX, HMX, HNS, PETN, and PYX.

A non-mass explosive body 130 is disposed in the hollow interior 126, adjacent the main explosive load 128. The non-mass explosive body 130 may be arranged within the hollow interior 126 of the shell 120, at a location between the open end 124 and the main explosive load 128. According to an aspect, the non-mass explosive body 130 includes an electrically conductive, electrically dissipative or electrostatic discharge (ESD) safe synthetic material. The non-mass explosive body 130 may be composed of a metal (or metal alloy) such as cast-iron, zinc, machinable aluminum or steel. Alternatively, the non-mass explosive body 130 may be composed of a plastic material.

The non-mass explosive body 130 may be substantially cylindrical. According to an aspect, the non-mass explosive body 130 includes a head portion 132, and a leg portion 134 opposite the head portion 132. The head portion 132 is disposed adjacent the main explosive load 128. A primary explosive 131 is embedded within the head portion 132, so that the non-mass-explosive body 130 protects the primary explosive 131 from being unintentionally initiated. According to an aspect, a secondary explosive 133 is adjacent the primary explosive 131. The secondary explosive 133 is configured to seal the primary explosive 131 within the head portion 132. The primary and secondary explosives 131, 133, disposed in the head portion 132, may collectively have a total thickness of about 3 mm to about 30 mm. To be sure, the thickness of the primary and secondary explosives 131, 133 may be adjusted based on the needs of the particular application and the types of explosives that are being utilized. In an embodiment, the primary explosive 131 includes at least one of lead azide, silver azide, lead styphnate, tetracene, nitrocellulose and BAX. The selected secondary explosive 133 may include a material that is less sensitive than the primary explosive 131. In an embodiment, the secondary explosive 133 includes at least one of PETN, RDX, HMX, HNX and PYX.

Figure 10A:
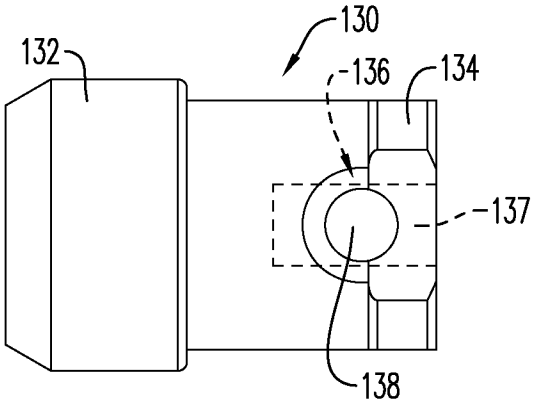
FIG. 10A is a side view of the non-mass explosive body of FIG. 8, illustrating an arrangement of channels in the non-mass explosive body, according to an embodiment.
Figure 10B:
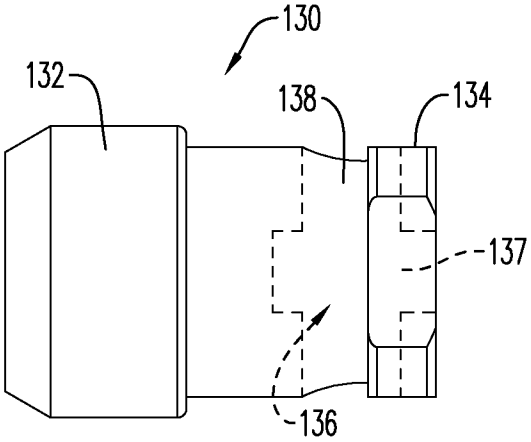
FIG. 10B is a side view of the non-mass explosive body of FIG. 8, illustrating another arrangement of channels in the non-mass explosive body, according to an embodiment.

According to an aspect and as illustrated in FIGS. 8-10B, the non-mass explosive body 130 includes one or more channels 136. The channels 136 are adjacent to or cooperate with the leg portion 134 of the non-mass explosive body. The channels may include a first channel 137 extending along a lengthwise dimension Y of the detonator 110, and a second channel 138 extending along a transverse dimension X of the detonator 110. In an embodiment, the first and second channels 137, 138 are configured to communicate with each other. As illustrated in FIG. 10A, the first channel 137 may abut the second channel 138 so that the first channel 137 is in fluid communication with the second channel 138. According to an aspect and as illustrated in FIG. 10B, the first channel 137 and the second channel 138 intersect one another, thereby forming a generally t-shaped channel at the leg 134 portion of the non-mass explosive body 130. The t-shaped channel consists of the first channel 137 and the second channel 138 in fluid communication with each other. As best seen in FIG. 9A, the non-mass explosive body 130 includes a plurality of planar surfaces 139 formed at the leg portion 134. When the non-mass explosive body 130 is positioned in the cylindrical shell 120, the planar surfaces 139 create a gap between the shell and the leg portion 134, which facilitates the introduction of fluid from a region external to the shell 120, into at least one of the first channel 137 and the second channel 138.

The detonator 110 further includes a cylindrical plug 150. The cylindrical plug 150 is secured in the hollow interior 126 of the shell 120, adjacent the non-mass explosive body 130 (FIGS. 7A-7C and 11). In this arrangement, the non-mass explosive body 130 and the main explosive load 128 are enclosed within the shell 120. The plug 150 is illustrated in FIGS. 7A, 7B and 7C as being positioned at the open end 124 of the shell 120. In this configuration, the plug 150 is at least partially disposed in the chamber 126 of the shell 120.

The plug 150 includes a first portion 152, and a second portion 154. According to an aspect, the plug 150 includes a recessed area 156 that extends around the circumference of the plug 150 between the first and second portions 152, 154. The first portion 152 may include a first outer diameter OD1, and the second portion 154 may include a second outer diameter OD2. The first and second outer diameters OD1, OD2 may be substantially the same, with the recessed area 156 between them. In an embodiment, the first outer diameter OD1 may be less than the second outer diameter OD2. According to an aspect, the first outer diameter OD1 of the first portion 152 may be substantially the same as an inner diameter ID of the shell 120. The first portion 152 is disposed within the chamber 126 of the shell 120 and may be secured therein by virtue of a compression fit or by crimping a portion of the shell onto the first portion 152. The recessed area 156 may help to facilitate the crimping, or otherwise securing, of the shell 120 onto the plug 150.

Figure 12A:
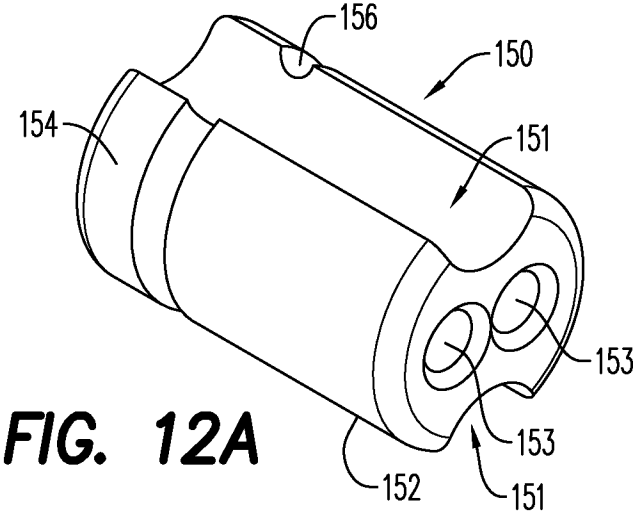
FIG. 12A is a side perspective view of the plug of FIG. 11, illustrating the elongated opening formed in the plug wires.
Figure 12B:
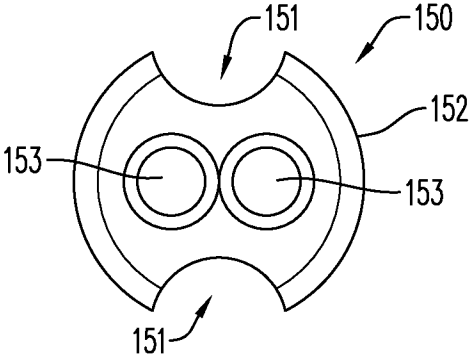
FIG. 12B is an end view of the plug of FIG. 11.
Figure 11:
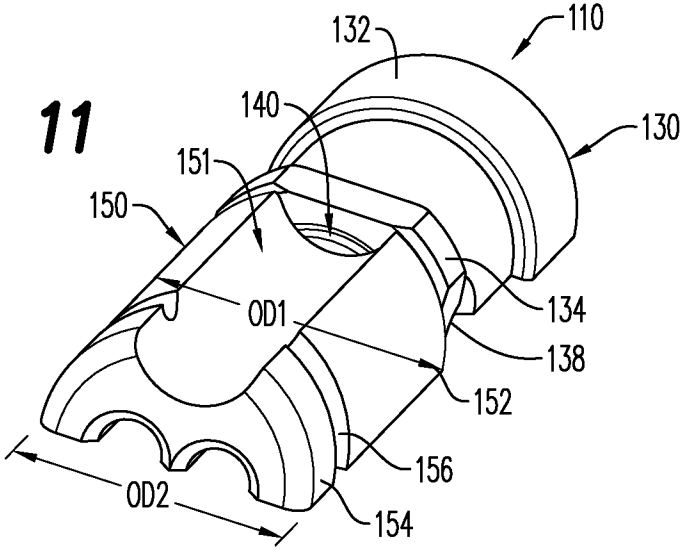
FIG. 11 is a partial, perspective view of a plug partially disposed in the non-mass explosive body of FIG. 8, according to an embodiment.

According to an aspect, an elongated opening/slot/recess/groove 151 extends along a length of the plug 150 (i.e., the longitudinal direction Y of the shell 120). As illustrated in FIGS. 12A and 12B, the elongated openings 151 of the plug 150 may include at least two parallel spaced-apart openings, slots, recesses or grooves. The plug 150 may include 3, 4, 5, or more elongated openings, the quantity of which may be selected based on the needs of the application. The elongated opening/(s) 151 are configured to provide a path that facilitates the communication of a fluid (such as, wellbore fluid) into the non-mass explosive body 130, and generally, the shell 120. According to an aspect, the elongated opening/(s) 151 and the channels 136 of the non-mass explosive body 130 collectively introduce the fluid into the non-mass explosive body 130, in order to disable the detonator 110.

A printed circuit board/PCB 140 is adjacent the first portion 152 of the plug 150. According to an aspect, the printed circuit board 140 is mechanically coupled to the first portion 152 of the plug 150. The PCB 140 may be secured to the plug 150 by any conventional mechanism, such as, adhesives, and also by friction as the leg wires 160 may be held securely in place inside the plug 150 as soon as the shell 120 is mechanically crimped onto the plug 150 or plug 50. For purposes of convenience, and not limitation, the general characteristics of the PCB 40, though applicable to the PCB 140, are described above with respect to the FIGS. 3-6, and are not repeated here.

Figure 8:
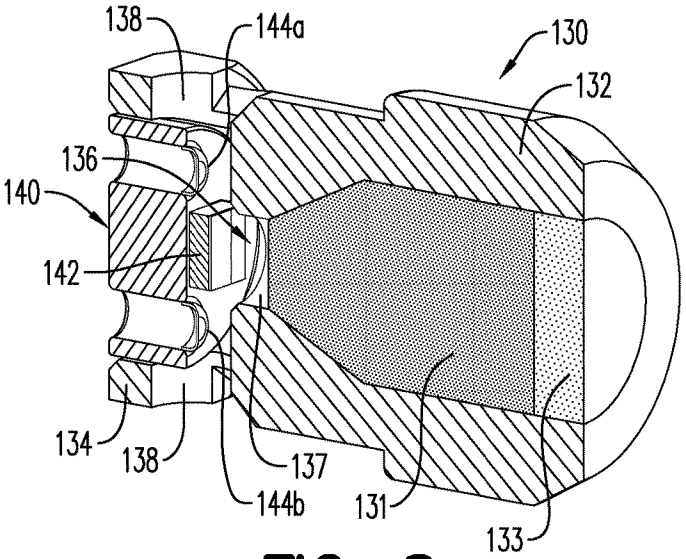
FIG. 8 is a side, cross-sectional view of a non-mass explosive body for use with a detonator, according to an embodiment.

The PCB 140 includes one or more components, such as contacts/relay contacts. According to an aspect and as illustrated in FIGS. 7C and 8, the PCB 140 includes a first contact 144*a*, and a second contact 144*b* spaced apart from the first contact 144*a*. A resistor 142 is disposed between a first contact 144*a* and a second contact 144*b*, and is in electrical communication with each of the contacts 144*a*, 144*b*. The resistor 142 may be a film resistor. According to an aspect, the film resistor is a surface mounted resistor. According to an aspect, the resistor 142 is a thin-filmed resistor having a thickness between about 10 μm to about 1000 μm, alternatively between about 10 μm to about 500 μm.

The detonator 110 may include a plurality of leg wires 160 extending through the plug 150. The leg wires 160 provide electrical connection to the PCB 140. The leg wires 160 may include a first leg wire 162 and a second leg wire 164. The first and second leg wires 162, 164 may each be secured in longitudinal slots/channels 153 that extend through the plug 150. The longitudinal slots 153 may extend in the same general direction as the elongated openings 151. The first leg wire 162 is electrically coupled to the first contact 144*a*, and the second leg wire 164 is electrically coupled to the second contact 144*b*, to provide electrical connection to the printed circuit board 140.

In use, the detonator 110 functions similar to the detonator 10 described hereinabove with reference to FIGS. 1-6. The resistor 142 is configured to explode and generate a high-energy plasma cloud, upon receiving sufficient current (which may be about 150V) from the contacts 144*a*, 144*b* (and indirectly from the leg wires 162, 164). The plasma cloud is configured to initiate the primary explosive 131 housed in the non-mass explosive body 130, and the primary explosive 131, in turn, is configured to initiate the main explosive load 128. The initiation of the main explosive load 128 is configured to initiation an axially-aligned detonating cord, as described hereinabove. If the perforating gun in which the detonator 110 is positioned has flooded or leaked (i.e., wellbore fluid has entered the detonator 110), the fluid will travel through the elongated openings 151 of the plug 150 to the channels 136 of the non-mass explosive body 130. When in the non-mass explosive body, the fluid creates a barrier between the resistor 142 and the primary explosive 131, and prevents initiation of the main explosive load 128. This safety feature helps to reduce the risk of a misfire, partial misfire or fire low-order of the perforating gun.

Embodiments of the present disclosure are further associated with a method 200 of using a detonator 10/110, such as a fluid-disabled detonator, that is associated with a perforating gun system in a wellbore. The detonator 10/110, which is positioned 220 within the perforating gun system, may be configured substantially as described hereinabove. Thus, for purposes of convenience and not limitation, the various features and arrangement of the detonator 10/110 described hereinabove and illustrated in FIGS. 1-12B are not repeated here.

The detonator 10/110 includes a shell 20/120 having a closed end, an open end, and a hollow area extending between the closed and open ends. A non-mass explosive body is disposed within the hollow area. The non-mass explosive body includes one or more channels that are in fluid communication with the wellbore. According to an aspect, a main explosive load is disposed within the hollow area between the closed end of the shell and the non-mass explosive body. A cylindrical plug 50/150 is positioned at the open end of the shell and is at least partially disposed in the hollow area. A printed circuit board including a resistor, is arranged adjacent the plug and is disposed within the hollow interior.

The method 200 further includes lowering 240 the perforating gun system into the wellbore and initiating 260 the detonator to trigger an explosive reaction. The detonator 10/110 may be initiated 260 by transmitting 262 a voltage or current through first and second leg wires of the detonator 10/110 to the resistor. The voltage may exceed a threshold voltage, which is required to burst the resistor so the resistor generates a high-energy plasma cloud for initiating the primary explosive, and thus initiating the main explosive load and detonating cord.

According to an aspect, in the event that a fluid has leaked into or flooded the perforating gun system, the channels of the non-mass explosive body, in combination with either the openings 21 of the shell 20 (i.e., of the detonator 10 illustrated in FIGS. 4-6) or the elongated openings 151 of the plug 150 (i.e., of the detonator 110 illustrated in FIGS. 7A-7C) facilitate entry/introduce of the fluid into the non-mass explosive body. The introduced fluid may create a barrier between the resistor and the main explosive load, which prevents initiation of the main explosive load and disables the detonator. According to an aspect, the fluid may be a conductive fluid. The conductive fluid may which short-circuit the first and second contacts, thus diverting the electrical current from the resistor and preventing the resistor from bursting to generate the plasma cloud.

The present disclosure, in various embodiments, configurations and aspects, includes components, methods, processes, systems and/or apparatus substantially developed as depicted and described herein, including various embodiments, sub-combinations, and subsets thereof. Those of skill in the art will understand how to make and use the present disclosure after understanding the present disclosure. The present disclosure, in various embodiments, configurations and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that variations in these ranges will suggest themselves to a practitioner having ordinary skill in the art and, where not already dedicated to the public, the appended claims should cover those variations.

The terms "determine", "calculate" and "compute," and variations thereof, as used herein, are used interchangeably and include any type of methodology, process, mathematical operation or technique.

The foregoing discussion of the present disclosure has been presented for purposes of illustration and description. The foregoing is not intended to limit the present disclosure to the form or forms disclosed herein. In the foregoing Detailed Description for example, various features of the present disclosure are grouped together in one or more embodiments, configurations, or aspects for the purpose of streamlining the disclosure. The features of the embodiments, configurations, or aspects of the present disclosure may be combined in alternate embodiments, configurations, or aspects other than those discussed above. This method of disclosure is not to be interpreted as reflecting an intention that the present disclosure requires more features than are expressly recited in each claim. Rather, as the following claims reflect, the claimed features lie in less than all features of a single foregoing disclosed embodiment, configuration, or aspect. Thus, the following claims are hereby incorporated into this Detailed Description, with each claim standing on its own as a separate embodiment of the present disclosure.

Advances in science and technology may make equivalents and substitutions possible that are not now contemplated by reason of the imprecision of language; these variations should be covered by the appended claims. This written description uses examples to disclose the method, machine and computer-readable medium, including the best mode, and also to enable any person of ordinary skill in the art to practice these, including making and using any devices or systems and performing any incorporated methods. The patentable scope thereof is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. A detonator for use in a wellbore, comprising:

a shell comprising a closed end, an open end, a hollow interior extending between the closed and open ends;

a non-mass explosive body disposed within the hollow interior, the non-mass explosive body comprising one or more channels and a primary explosive embedded in a portion of the non-mass explosive body;

a main explosive load disposed within the hollow interior between the closed end of the shell and the non-mass explosive body;

a cylindrical plug comprising an elongated opening extending along a length of the plug, wherein the plug is positioned at the open end of the shell and is at least partially disposed in the hollow interior; and a printed circuit board extending from the cylindrical plug into the hollow interior, wherein the printed circuit board comprises a resistor, wherein the elongated opening facilitates communication of a fluid into the shell, and wherein the elongated opening and the channels are configured to introduce the fluid into the non-mass explosive body to disable the detonator.

2. The detonator of claim 1, wherein the non-mass explosive body comprises an electrically conductive, electrically dissipative or electrostatic discharge safe synthetic material.

3. The detonator of claim 1, wherein the non-mass explosive body is substantially cylindrical, and the head portion adjacent the main explosive load and a leg portion opposite the head portion.

4. The detonator of claim 1, wherein the non-mass-explosive body protects the primary explosive from being unintentionally initiated.

5. The detonator of claim 1, further comprising:

a secondary explosive adjacent the primary explosive, wherein the secondary explosive seals the primary explosive within the head portion.

6. The detonator of claim 5, wherein the primary and secondary explosives are disposed in the head portion and collectively have a total thickness of about 3 mm to about 30 mm.

7. The detonator of claim 5, wherein the primary explosive comprises at least one of lead azide, silver azide, lead styphnate, tetracene, nitrocellulose and BAX and wherein the secondary explosive comprises a material that is less sensitive than the primary explosive.

8. The detonator of claim 5, wherein the secondary explosive comprises at least one of PETN, RDX, HMX, HNX and PYX.

9. The detonator of claim 1, wherein the plug comprises:

a first portion having a first outer diameter;

a second portion having a second outer diameter; and a recessed area extending around the circumference of the plug between the first and second portions, wherein the first outer diameter of the first portion is substantially the same as an inner diameter of the shell, and the first portion is disposed within the hollow interior of the shell, such that the non-mass explosive body and the main explosive load are enclosed within the shell.

10. The detonator of claim 9, wherein:

the printed circuit board is adjacent the first portion of the plug, and the resistor is disposed between a first contact and a second contact, such that the resistor is in electrical communication with the first and second contacts.

11. The detonator of claim 10, wherein the printed circuit board is disposed within a slot formed by a leg portion of the non-mass explosive body, and the resistor is positioned between the first contact and the second contact in a spaced apart configuration.

12. The detonator of claim 10, further comprising:

a first leg wire extending through the plug, the first leg wire being electrically coupled to the first contact; and a second leg wire extending through the plug, the second leg wire being electrically coupled to the second contact, wherein the first and second leg wires are spaced apart from each other and provide electrical connection to the printed circuit board.

13. The detonator of any of claim 12, wherein first and second leg wires are each secured in longitudinal slots extending through the length of the plug.

14. The detonator of claim 10, wherein the fluid comprises:

a conductive fluid, wherein in the event that the conductive fluid is introduced in the non-mass explosive body, the conductive fluid short-circuits the first and second contacts, thus diverting an electrical current from the resistor and preventing the resistor from bursting to generate the plasma cloud.

15. The detonator of claim 1, wherein the channels comprise:

a first channel extending along a lengthwise dimension of the detonator; and a second channel extending along a transverse dimension of the detonator, wherein the first channel and the second channel intersect one another so that the first channel is in fluid communication with the second channel.

16. The detonator of claim 1, wherein the non-mass explosive body comprises a metal selected from one of:

a group consisting of cast-iron, zinc, machinable steel and aluminum; and a plastic material.

17. The detonator of claim 1, wherein the resistor is configured to explode upon initiation of the detonator to generate a high-energy plasma cloud that initiates a primary explosive embedded within the non-mass explosive body.

18. The detonator of claim 1, wherein the resistor is a film resistor.

19. The detonator of claim 1, wherein the film resistor is a surface mounted resistor.

20. The detonator of claim 1, wherein the elongated opening of the plug comprises at least two parallel spaced-apart openings.

* * * * *